United States Patent [19]

Feyrer et al.

[11] 3,982,692

[45] Sept. 28, 1976

[54] CLAMPING MEANS FOR ELEVATOR GUIDE RAILS AND THE LIKE

[75] Inventors: Klaus Feyrer, Esslingen; Wolfgang P. Müeller, Lahr, both of Germany

[73] Assignee: R. Stahl Aufzuege GmbH, Stuttgart, Germany

[22] Filed: July 11, 1975

[21] Appl. No.: 594,957

[30] Foreign Application Priority Data

July 19, 1974 Germany ..... 2434806

[52] U.S. Cl. ..... 238/349; 187/95

[51] Int. Cl.[2] ..... E01B 9/34

[58] Field of Search ..... 187/95; 238/349, 351

[56] References Cited

UNITED STATES PATENTS

| | | | |
|---|---|---|---|
| 754,881 | 3/1904 | Masik | 238/349 X |
| 1,925,867 | 9/1933 | Dunlop | 187/95 |
| 2,009,309 | 7/1935 | Davies et al. | 238/349 X |
| 2,479,932 | 8/1949 | Hunnicutt | 238/349 X |
| 3,831,842 | 8/1974 | Tamura | 238/349 |
| 3,888,413 | 6/1975 | Molyneux | 238/349 |

FOREIGN PATENTS OR APPLICATIONS

| | | | |
|---|---|---|---|
| 1,111,832 | 3/1956 | France | 238/351 |

*Primary Examiner*—Evon C. Blunk
*Assistant Examiner*—James L. Rowland
*Attorney, Agent, or Firm*—Lawrence E. Laubscher

[57] ABSTRACT

Clamping means are disclosed for connecting the lateral edges of the foot portion of a T-shaped rail to a support in such a manner as to permit limited separation between the rail and the support components while restraining the rail against lateral displacement relative to the support. Each clamping device is formed from a unitary resilient metal blank having a fastening portion secured to the support to prevent lateral displacement of the rail, a resilient blade portion for biasing the rail against the support, and at least one stop portion limiting the extent to which the rail may be separated from the support against the biasing force of the blade portion.

10 Claims, 9 Drawing Figures

CLAMPING MEANS FOR ELEVATOR GUIDE RAILS AND THE LIKE

STATEMENT OF THE INVENTION

This invention relates to clamping means for securing a T-shaped rail — such as the guide rail of an elevator shaft — to a support in a manner to permit limited separation between the rail and the support while restraining the rail against lateral displacement. The clamping means includes a plurality of clamping devices each of which is formed from a resilient metal blank, such as spring steel.

BRIEF DESCRIPTION OF THE PRIOR ART

The attachment of guide rails for the cage and counterweight components of an elevator system assumes special significance owing to the fact that concrete shafts are subject to structural shrinkage which frequently has not yet been completed by the time the guide rails are mounted in such shafts (either on the corresponding shaft walls, on a shaft frame, or on retaining clips). The installation of guide rails in elevator shafts therefore must be so accomplished that a relative motion will be possible between the guide rails and the rail retention device due to structural shrinkage without there being a possibility of an undesirable distortion of the rails. It has been proposed to use elastic clamping plates in elevator construction, whereby it is possible to place the guide rails — with a limited pressing force — against corresponding rail retention devices in a friction locking manner. Similarly clamping plates have been proposed in crane apparatus for the attachment of running rails.

In two of these known designs, the plate body portion of these clamping plates is so formed — either along its longitudinal side or from its two ends — that the pointed elastic plate portion which extends downwardly at its free end, extends forwardly beyond the front edge of the body portion of the clamping plate and will press the rail foot upon the support (as shown in German Auslegeschrift No. 2,225,260, German Pat. No. 946,347, and German Design Pat. No. 1,841,455).

These known clamping devices all share the disadvantage that one cannot reliably limit a one-sided lift-off of the rail foot (resulting, for example, from the strong lateral forces acting upon the rail head), thereby often resulting in complete separation of the rail from the clamping means, or in failure or destruction of the clamping means.

It has been previously proposed to provide a clamping device with a stop that prevents the rail foot from being lifted off the rail carrier. In this design, the shank of the clamping body — which protrudes beyond the front end of the fastening plate and which partially extends over the rail foot — carries a U-shaped lining consisting of nonferrous metal, for example, brass, which in itself encompasses the longitudinal edge portion of the rail foot to be fastened on a small segment. The interval between the shank carrying the lining and the placement surface of the clamping device is so selected that, when the fastening plate is secured to the rail carrier, the shank will place the rail foot against the rail retention device with a certain pressed-on force. In this known design, the spring pitch of the elastically arranged shank is limited during the rising phase by a bolt which first of all serves to secure the fastening plate to the rail carrier and which, for the purpose of the previously mentioned limitation of the spring pitch, is held with its head at a predetermined interval from the outside of the elastic shank, so that this bolt head will form the stop for this shank and thus constitute security for preventing the rail against being lifted off from the rail retention device.

However, the functional efficiency of this clamping device is not assured in every case because it has been found in practice that — when the prestressing force is exceeded by the operating force — the stop first of all is ineffective and one must therefore anticipate a breakage of this shank at its most heavily stressed point in the area of the round-bent connection portion. In such a case, the required friction-locking effect between the rail and the clamping device is immediately cancelled out and the guide rail is separated from the particular rail retention device at the corresponding point. The screw forming the stop here must be specially produced as a special screw and, when installed, sticks out very far beyond the outside of the elastic shank which, among other things, greatly restricts the space left for the elevator cage accessories.

SUMMARY OF THE INVENTION

The present invention was developed to provide an elastic clamping device for biassing a rail against the rail carrier in a friction-locking manner and which provides security against the lifting of the rail foot from the rail carrier after the biassing force of the clamping means has been exceeded.

To solve this problem, the invention employs a clamping device which is characterized by the provision of stop means for securing the rail against lifting off from the rail carrier in the area of the end of the fastening plate facing toward the rail head, said stop means being defined by a projection that extends partially over and is spaced from the rail foot by a small interval.

The clamping device of the present invention is formed relatively inexpensively from a resilient metal blank of a comparatively narrow width so that — on the basis of its small dimensions — it can be mounted anywhere in an elevator shaft, as desired. The arrangement of the stop portion on the fastening plate ensures that, in case of stresses going beyond normal elevator operation, strong lateral forces attacking the rail head cannot cause the excessive stretching of the spring blade portion to an extent that would cause the blade portion to rupture at the point of connection with the fastening plate.

Accordingly, the primary object of the present invention is to provide clamping means arranged adjacent the lateral edges of the foot portion of the rail, each of said clamping means including resilient blade means for biasing the rail against the rail carrier, and stop means for limiting the extent to which the rail may be separated from the rail carrier. Preferably the various clamping means are secured to the rail carrier in a manner to prevent lateral displacement of the rail relative to the support.

A more specific object of the invention is to provide a clamping device formed from a unitary blank of resilient metal, such as spring steel, said blank being bent to a generally U-shaped configuration to define a fastening portion that is fastened to the rail carrier in abutting engagement with one lateral edge of the rail, and a resilient blade portion that extends partially over the rail against the rail carrier. An ear portion bent upwardly from the fastening portion carries a stop portion that extends in slightly spaced relation above the rail foot portion, thereby limiting the extent to which the rail edge portion may be separated from the rail against the biassing force of the resilient blade portion. To improve the operation of the clamping means, at least one of the surfaces of the blade, ear and stop portions of the clamp device that are engaged by the surface of the rail foot portion is covered with a material having a low coefficient of friction (for example, a synthetic plastic material, such as Teflon or the like). In one embodiment, a single ear and stop portion is provided on one side of the resilient blade portion; in another embodiment, a pair of ear and stop portions are arranged on opposite sides of the resilient blade portion.

A further object of the invention is to provide a rail assembly including a generally T-shaped rail having head and foot portions, a rail carrier, and clamping means including a plurality of clamping devices arranged adjacent the lateral edges of the rail foot portion for preventing lateral displacement of the rail relative to the support, each of said clamping devices including means biassing the rail foot portion against the rail carrier, and stop means limiting the extent to which the rail may be separated from the rail carrier against the biassing force of the biassing means.

BRIEF DESCRIPTION OF THE DRAWING

Other objects and advantages of the invention will become apparent from a study of the following specification when viewed in the light of the accompanying drawing, in which.

DETAILED DESCRIPTION

Figure 1:
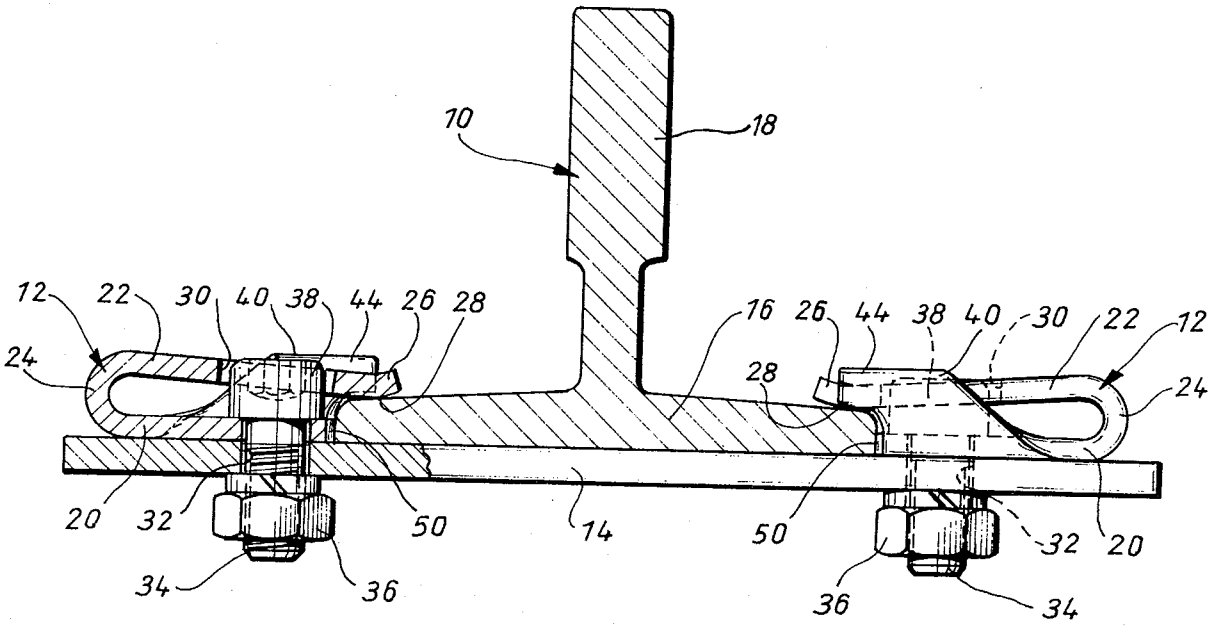
FIG. 1 is a partially sectioned top plan view of the improved rail assembly including a pair of the clamping devices of the present invention.

Referring now more particularly to FIG. 1, a generally T-shaped guide rail 10 for guiding an elevator cage or a counterweight in an elevator shaft is resiliently held by means of a plurality of clamping devices 12 which are arranged in longitudinally spaced relation at predetermined points, in pairs opposite each other, on a rail carrier 14 in a friction-locking pattern, so that a structural shrinkage of the elevator shaft (for example, a shaft made in particular of reinforced concrete in which a shrinkage may not yet have been completed at the same time the guide rails of the particular elevator system are installed) will not be able to act disadvantageously along the guide rails to distort them to a disturbing degree. For this purpose, the rail foot portion 16 of the illustrated guide rail 10 is biassed by means of clamping means 12 with a predetermined pressure force against the support surface of the rail carrier 14 so that, in case of a structural shrinkage between rail foot 16 and carrier 14, a relative separating motion can take place. Clamping devices 12 are furthermore so constructed that they can reliably — independently of the part of the clamping device which exercises the pressure force upon rail foot 16 — limit a one-sided lift-off of the rail foot 16 which might be caused by strong lateral forces acting upon rail head 18.

Finally, the clamping means 12 guarantee the perfect guidance of the guide rails in their longitudinal direction. In order to achieve a rail retention in the manner described above, the clamping devices includes an essentially U-shaped clamping body which has at least two shank portions, one of which forms a flat fastening portion 20 while the other one forms at least one spring blade portion 22, which blade portion is elastically connected with the fastening portion 20 by means of a curved intermediate connecting portion 24. The spring blade portion 22 protrudes with its free terminal portion 26 over the front end of fastening portion 20 to partially overlap one of the two edge portions of rail foot portion 16 and is biassed thereagainst with a certain force so that the spring blade will exert upon the rail foot sufficient pressure to retain the rail upon the rail carrier 14 in a friction-locking manner. Terminal portion 26 of spring blade portion 22 is bent upwardly so that the spring blade will touch the rail foot merely along one line with a convex-curved support surface 28, whereby the friction existing between these parts will be reduced to the optimum degree. Spring blade portion 22 and fastening portion 20 contain aligned bore holes 30 and 32, respectively, whereby one can plug a fastening bolt 34 into the borehole 32 of the fastening plate and this fastening bolt 34 is attached to the rail carrier 14 by means of a nut 36 and thus comes to rest with a cylindrical bolt head 38 that contains an internal hexagonal recess that engages the fastening plate 20 and thus holds it in place. The diameter of borehole 38 can be gripped through the spring blade with radial leeway.

Spring blade 22 has a soft spring characteristic and a flat spring characteristic which is mainly accomplished by a sufficiently large curvature radius of the intermediate connecting portion 24, a cross-section of the spring blade with a small resistance moment, and a correspondingly great bending length. The spring blade portion extends slightly forwardly and downwardly in order, during normal elevator operation, to achieve the prestressing which prevents the lift-off of the rail foot and which is also sufficient for bridging commercially customary rail foot tolerances of, for example, $\pm 0.75$ mm and other minor shape deviations along rail carrier 14 and clamping means 12, with an only minor decline in the biassing force.

Figure 2:
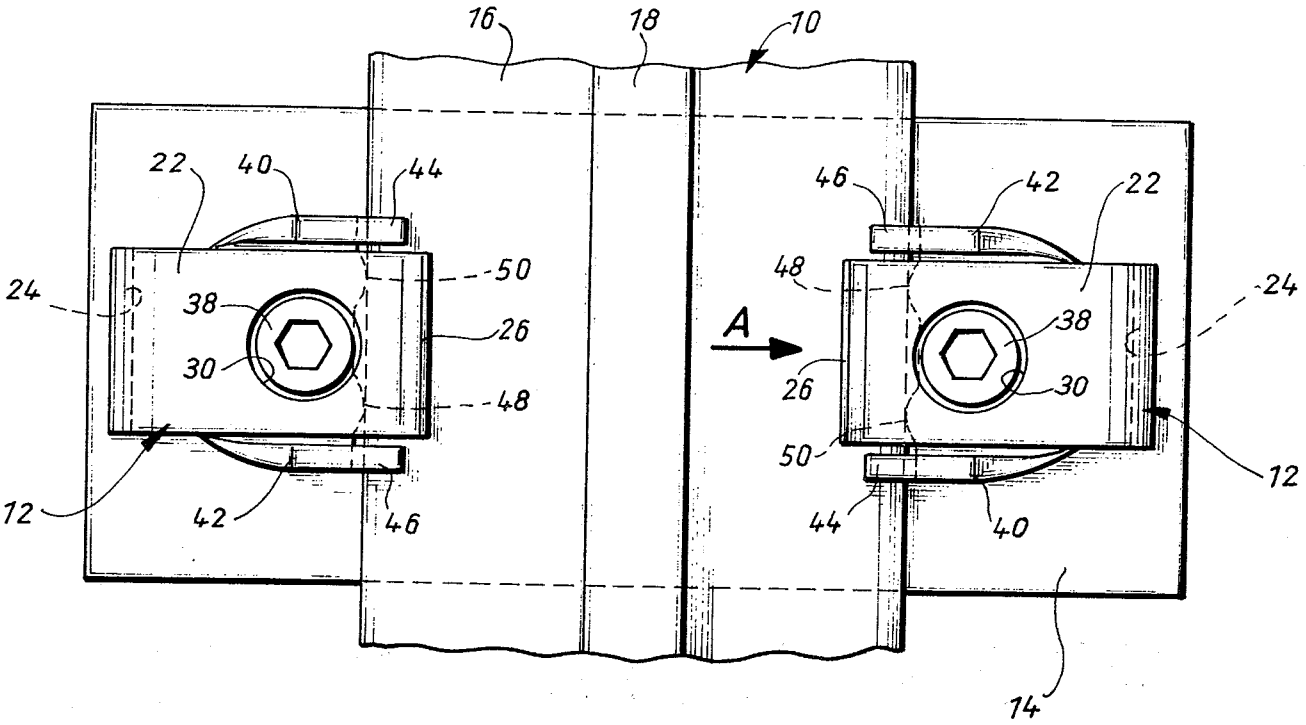
FIG. 2 is a front elevational view of the rail assembly of FIG. 1.

The clamping devices shown in FIGS. 1 and 2 contain, on the side of spring blade portion 22, in each case, an ear portion 40, 42 which is bent upwardly and which is formed along both longitudinal sides of fastening portion 20 and on these ears there is formed in each case an axially extending stop portion 44 and 46, respectively, which overlaps and is spaced from the edge portions of rail foot 16 by a small interval of, for example, 0.5–1.5 mm. Consequently, the stop portions 44 and 46 limit — in case of stresses on the guide rail due to the lateral forces attacking the rail head in a lateral direction, i.e., forces which are greater than customary during normal elevator operation — the extent to which the rail foot 16 can be lifted off from carrier 14, whereby the spring blade will not be overstressed and ruptured at its point of connection with the fastening portion 20. Stop projections 44 and 46 thus ensure effective retention of the rail foot against the twisting produced by lateral forces which attack more strongly at the rail head.

As we can see from FIG. 2, the fastening portion 20 is provided on its free front edge facing the rail foot with two protrusions 48 and 50 that are arranged at an interval from each other and that in each case contain a convex support surface; these protrusions abut and serve to prevent lateral displacement of the rail foot during relative separating motion between rail carrier 14 and guide rail 10. The convex curvature of the support surface of these protrusions keeps the friction forces small.

Figure 6:
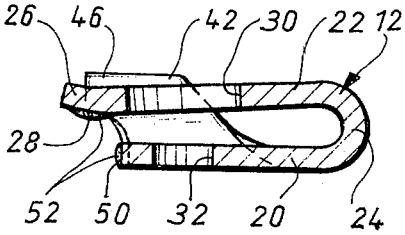
FIG. 6 is a longitudinal sectional view of the clamping device of FIGS. 1–4.
Figure 7:
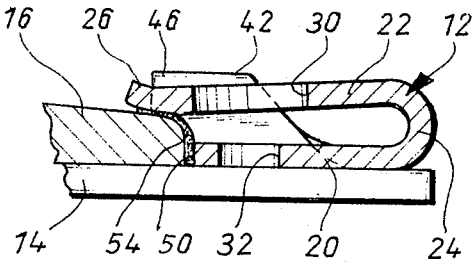
FIG. 7 illustrates a modification of the clamping device of FIG. 6.

As can be seen from FIG. 6, the shiftability of the guide rail with relation to the clamping means can be further improved in that the guidance and support surfaces 28, 48, 50 of the spring blade 22, which are in contact with the rail foot, are equipped with a coating 52 consisting of a material having a low friction coefficient (such as Teflon, for example). Instead of these coatings, the clamping device according to FIG. 7 can be provided with a friction reducing member 54 which corresponds with the lateral cross-section profile of the edge pieces of the rail foot portion 16 and which consists of a suitable material with a low sliding coefficient (such as Teflon or the like), and which, when attached to the lateral edge of the rail foot, is between the latter and the guidance and support surfaces 28, 48, 50 of the particular clamping device.

Figure 3:
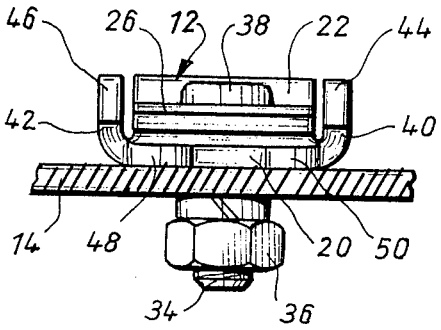
FIG. 3 is a detailed sectional view of a clamping device of the assembly of FIGS. 1 and 2 taken in the direction of the arrow A in FIG. 2, the rail foot portion being omitted for clarity.
Figure 4:
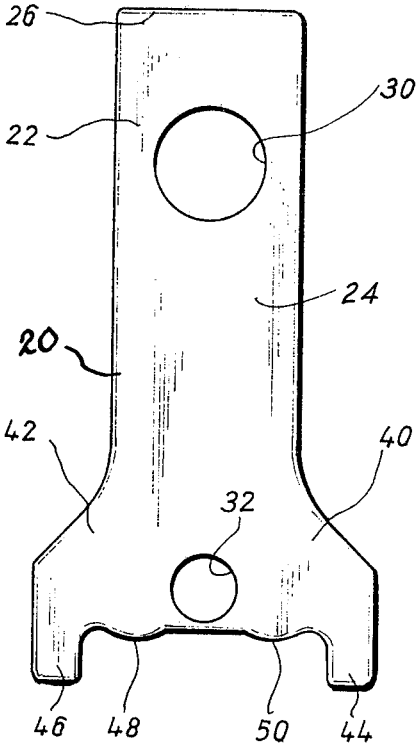
FIG. 4 is a top plan view of the resilient metal blank from which the unitary clamping device is formed.

FIG. 4 illustrates a blank which was stamped out of a corresponding piece of spring steel plate and from which one can make the clamping devices illustrated in FIGS. 1–3, whereby preferably the fastening portion 20 and the spring blade portion 22 have the same width.

Figure 5:
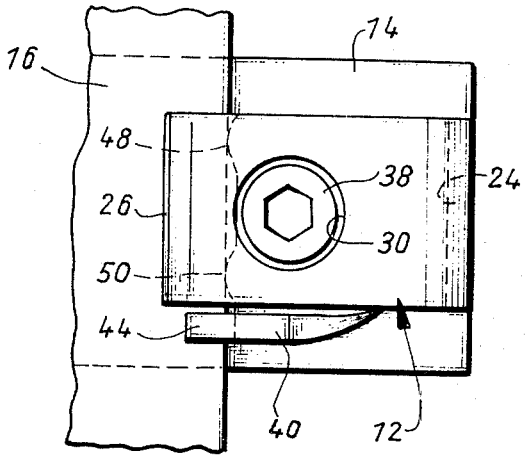
FIG. 5 is a detailed view of a modification of the clamping device of FIGS. 1–4, wherein only single ear and stop portions are provided.

The example of a clamping device shown in FIG. 5 differs from the previously described designs merely by the fact that only a single lateral ear 40 is provided on the fastening plate of this device, a stop projection 44 being formed on that ear portion.

Figure 8:
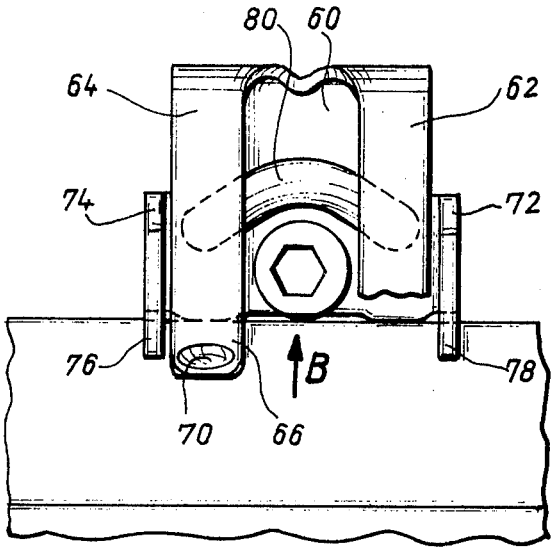
FIG. 8 is a detailed view of a modified clamping device.
Figure 9:
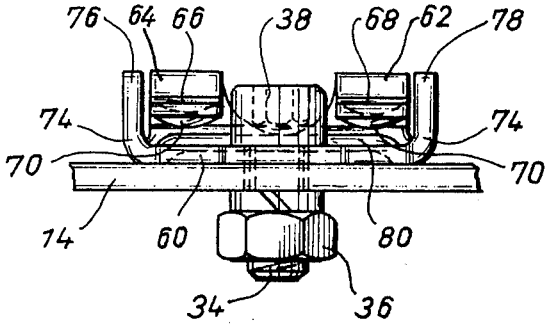
FIG. 9 is a detailed sectional view of the clamping device of FIG. 8 taken in the direction of the arrow B in FIG. 8, the rail foot portion being omitted for clarity.

The example of a clamping device shown in FIGS. 8 and 9, in contrast to the clamping devices in FIGS. 1–3, contains two spring blades 62, 64 which are formed on one fastening plate 60, said blades having terminal portions 66 and 68 which protrude beyond the front edge of the fastening plate and rest upon the rail foot. The terminal blade portions contain embossings 70 which are correspondingly formed above, thereby assuring that the spring blades will merely be in point contact with the rail foot. In this example, there is — to the side of the fastening portion 60 and along the outer longitudinal edge of both spring blades 62, 64 — in each case provided a stop projection 76 and 78, respectively, and which, similar to the above-described examples, likewise overlap the rail foot. The number 80 designates a reinforcing deformation which is formed in the fastening plate 60 from the underside thereof and which even in the case of a relatively thin-walled steel plate assures adequate rigidity.

While in accordance with the provisions of the Patent Statutes the preferred form and embodiments of the invention have been illustrated and described, it will be apparent that changes may be made without deviating from the inventive concepts set forth above.

What is claimed is:

1. Clamping means (12) for resiliently fastening in a laterally guided manner the guide rail (10) of an elevator or the like to a rail carrier (14), said rail having a generally T-shaped cross-sectional configuration and including rail foot (16) and rail head (18) portions, said clamping means comprising a unitary generally planar resilient metal blank, a. said blank having at one end a flat fastening portion (20) adapted to be fastened with the rail carrier adjacent one side of, and generally normal to, the foot portion of the rail;

b. said blank having at its other end a resiient blade portion (22) that is connected with said fastening portion by an intermediate portion (24), said blade portion being reversely bent about said intermediate portion to a position above, and in parallel spaced relation, to said fastening portion, the length of said blade portion and the spacing distance between said blade and fastening portions being such that said blade portion is adapted to extend above, and in engagement with, the upper surface of the rail foot portion;

c. said fastening portion having at least one lateral ear portion (40) that is bent upwardly about an axis parallel with the longitudinal axis of said blank to a position normal to said fastening portion adjacent the lateral edge of said blade portion;

d. said ear portion including adjacent the free end of said fastening portion an axially extending stop portion (44) that is adapted to extend beyond the free extremity of said fastening portion in slightly spaced relation above said rail foot portion, whereby said resilient blade portion permits a degree of separating movement between said rail and said rail carrier that is limited by said stop portion.

2. Clamping means as defined in claim 1, wherein the free end of said fastening portion is adapted to be secured to said rail carrier in abutting engagement with the adjacent lateral extremity of the rail foot portion.

3. Clamping means as defined in claim 2, wherein said fastening portion is provided at its free end with a pair of laterally-spaced axially-extending protrusions (48, 50) that are adapted to abuttingly engage the adjacent lateral extremity of the rail foot portion.

4. Clamping means as defined in claim 3, and further including a layer (52) of material having a low coefficient of friction secured to the surfaces of said protrusions that are adapted to engage the lateral extremity of the rail.

5. Clamping means as defined in claim 2, wherein said fastening portion contains at least one aperture (32) by means of which said fastening portion may be bolted to said rail carrier.

6. Clamping means as defined in claim 5, wherein said blade portion contains an access opening (30) opposite the aperture contained in said fastening portion, said opening being of a larger size than said aperture to permit access to the bolt fastening means.

7. Clamping means as defined in claim 1, wherein the surface of the free extremity of the blade portion adjacent said fastening portion is convex, thereby to reduce the area of surface engagement between said blade portion and said rail foot portion.

8. Clamping means as defined in claim 7, and further including a layer (52) of material having a low coefficient of friction secured to said convex blade surface.

9. Clamping means as defined in claim 1, wherein the end extremity of the ear portion at the free end of the fastening portion and the adjacent surface of the stop portion merge and have a configuration corresponding with the adjacent surface of the rail, and further including a layer (52) of material having a low coefficient of friction secured to the merging surfaces of said ear and stop projection surfaces.

10. A rail assembly, including a. a rail (10) having a generally T-shaped cross-sectional configuration, thereby defining rail foot (16) and rail head (18) portions;

b. a support (14) having a flat surface upon which the bottom of the foot portion of said rail is supported; and c. a plurality of clamping means (12) connecting the foot portions of said rail with said support, each of said clamping means consisting solely of a unitary resilient metal blank having a generally U-shaped cross-sectional configuration and including 1. a flat fastening portion (20) connected with said support, said flat fastening portion including lateral stabilizing means (48, 50) in engagement with the corresponding lateral edge of the rail foot portion to prevent lateral movement of said rail relative to said support;
2. a spring blade portion (22) resiliently connected with said flat fastening portion and extending above said flat fastening portion and partially above said rail foot portion for biasing said rail into engagement with said support, thereby to permit limited displacement of said rail against the biasing force of said spring blade portion away from said support; and
3. at least one stop portion (44, 46) connected with said flat fastening portion and extending in spaced relation partially above said rail foot portion for limiting the extent of displacement of said rail away from said support.

* * * * *